US007661368B2

(12) United States Patent
Riess et al.

(10) Patent No.: US 7,661,368 B2
(45) Date of Patent: Feb. 16, 2010

(54) HARD-CORE JACKETED BULLET WITH TRACER COMPOSITION AND METHOD OF MANUFACTURE THEREOF

(75) Inventors: Heinz Riess, Furth (DE); Erich Muskat, Roth (DE)

(73) Assignee: RUAG Ammotec GmbH, Furth (DE)

( * ) Notice: Subject to any disclaimer, the term of this patent is extended or adjusted under 35 U.S.C. 154(b) by 36 days.

(21) Appl. No.: 11/571,772

(22) PCT Filed: Jun. 28, 2005

(86) PCT No.: PCT/EP2005/006941

§ 371 (c)(1),
(2), (4) Date: Dec. 19, 2007

(87) PCT Pub. No.: WO2006/005439

PCT Pub. Date: Jan. 19, 2006

(65) Prior Publication Data

US 2008/0196617 A1 Aug. 21, 2008

(30) Foreign Application Priority Data

Jul. 8, 2004 (DE) ..... 10 2004 033 017

(51) Int. Cl.
*F42B 12/38* (2006.01)
*F42B 30/02* (2006.01)

(52) U.S. Cl. ..... 102/513; 102/501; 86/55

(58) Field of Classification Search ..... 102/439, 102/444, 498, 513, 514, 516, 518, 529; 86/55
See application file for complete search history.

(56) References Cited

U.S. PATENT DOCUMENTS 1,432,669 A * 10/1922 Clay ..... 102/513
2,115,047 A * 4/1938 Stevenson et al. ..... 149/44
2,958,287 A * 11/1960 Auxier ..... 102/507
3,013,495 A * 12/1961 Stevenson et al. ..... 102/513
5,714,707 A * 2/1998 Ruia ..... 86/49

FOREIGN PATENT DOCUMENTS

AT 84321 6/1921

* cited by examiner

*Primary Examiner*—James S Bergin
(74) *Attorney, Agent, or Firm*—Antonelli, Terry, Stout & Kraus, LLP.

(57) ABSTRACT

The aim of the invention is to gas-tightly join a jacket to a core of a hard core jacketed bullet comprising an illuminant composition in the area of the hole of the bore in the core to accommodate the illuminant composition. Said aim is achieved by pressing the material (15) of the bottom (11) of the jacket (4), which is displaced when the hole (10) is formed, against the wall of the hole by means of a reshaping process in the area of the hole (10).

10 Claims, 1 Drawing Sheet

Figure 1:
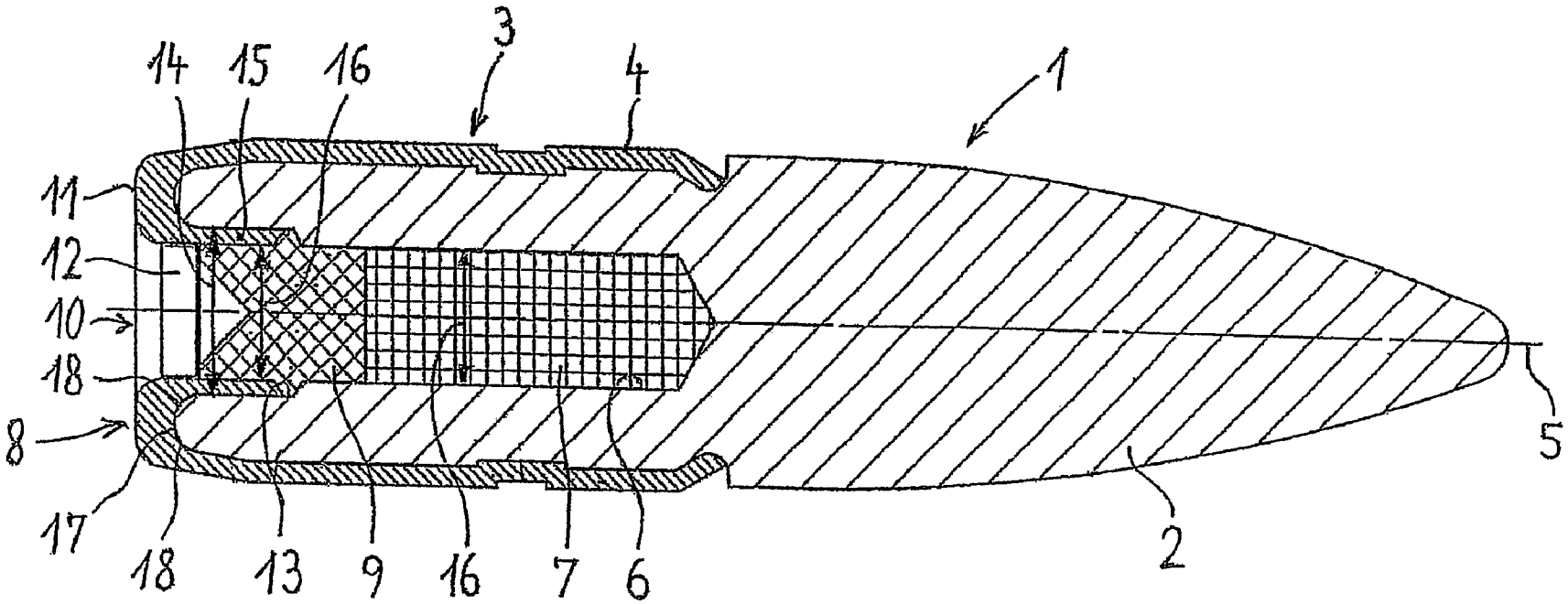

HARD-CORE JACKETED BULLET WITH TRACER COMPOSITION AND METHOD OF MANUFACTURE THEREOF

The invention relates to a hard-core jacketed bullet with tracer composition and a method of manufacture thereof.

Tracer bullets are bullets that contain a tracer composition, which upon firing is ignited and the combustion of which makes it possible to trace the trajectory of the bullets. Particularly when firing at night, tracer bullets facilitate target acquisition and target sighting.

The tracer composition is situated in a bore that is disposed in the longitudinal axis of the bullet in the bullet core. If the bullet is a jacketed bullet, the jacket in the rear region of the bullet has to be open in the region of the opening of the bore. In this case, the opening has to be of a configuration that prevents the gas produced by combustion of the tracer composition from passing between jacket and core and the subsequent gas pressure from causing the jacket to burst open or even being detached from the core. Damage to the jacket or a gas leak has a negative influence on the trajectory of the bullet and leads to misses.

The object of the present invention is, in a hard-core jacketed bullet with tracer composition, to guarantee a gastight seal between the jacket and the core in the region of the opening of the bore for the tracer composition.

The object is achieved according to the invention in that, after mounting of the jacket onto the core, the jacket in the rear region of the bullet, the base of the jacket, is broached in the centre of the opening of the bore for the tracer composition by means of a punch provided with a conical tip and during engagement of the punch into the bore the jacket material is pressed uniformly against the wall of the bore. The jacket is therefore not just bent over the edge of the bore. The operation is comparable to forming. The material of the base, which is situated in the rear region of the cartridge case and is thicker than the jacket, is pushed by means of the punch into the bore, so that the drawing or forming operation begins and the thickness of the base extending into the bore is substantially reduced, wherein the opening to the bore is produced. The gas tightness is achieved already when the material has been pressed along a length of approximately one millimetre against the wall of the bore. Even in the event of eccentric tearing of the jacket, the tightness is still guaranteed and no gas leak arises. At the opening, there is no need to solder the jacket to the core.

The diameter of the punch for producing the opening is adapted to the wall thickness that the jacket material pressed against the wall of the bore is required to have in order to withstand the anticipated gas pressure and prevent the gas from passing underneath it. The wall thickness of the material pressed against the wall of the bore is between 0.1 mm and 1.5 mm, dependent on the gas pressure prevailing, which may be approximately 3500 bar to 4000 bar.

The invention is described and its advantages compared to the background art are explained with reference to an embodiment that is illustrated in the drawing.

The hard-core jacketed bullet 1 comprises a core 2, which in its cylindrical part 3 used to guide the bullet in the barrel is encased by a jacket 4. Situated in a bore 6 extending centrically relative to the bullet axis 5 is a tracer composition 7, in front of which in the direction of the rear 8 of the bullet 1 an ignition charge 9 is disposed. The opening 10 to the bore 6 in the base 11 of the jacket 4 is sealed by a cover 12.

As is evident from the drawing, the bore 6 is stepped. The region 13 of the bore 6 in the rear 8 of the hard core, into which the material of the base 11 is pressed, has a diameter 14, which is extended in each case by approximately the wall thickness of the displaced material 15. The opening 10 therefore has the same diameter 16 as the bore 6, thereby facilitating the pressing-in of the tracer composition 7 and the ignition charge 9. This moreover prevents the edges of the jacket material 15 displaced into the region 13 from forming a working surface for the gases that arise during combustion of the pyrotechnic charges 7 and 9.

The rear 17 of the hard core 2 further has inside and outside there arises a radius, edges 18 rounded-off by the forming operation in the region of the opening 10 [sic]. This prevents tearing of the material that flows over the inner edge 18 during the formation of the opening 10 in the base 13 of the jacket 4.

The hard-core jacketed bullet with tracer composition according to the invention is easy to manufacture. The seal between jacket and core in the region of the opening to the bore for the tracer composition is achieved without soldering, solely by the interference fit of the base material that is displaced against the wall of the bore during broaching of the hole in the base by means of a working step comparable to forming.

The method of producing the opening in the base of the bullet jacket is usable for all calibres.

The invention claimed is:

1. A hard-core jacketed bullet with a tracer composition, comprising a hard core and a jacket encasing at least a rear part of the hard core, the hard core having a bore at a rear thereof, the bore having a forward region in which a tracer composition is contained and an opening in a rear region, wherein the bore in the region of the opening has a widened region for receiving the material of the base of the jacket that is displaced during the production of the opening so that the diameter of the opening with displaced material of the jacket therein is at least equal to the diameter of the bore at the forward region in which the tracer composition is contained.

2. The hard-core jacketed bullet according to claim 1, characterized in that the diameter of the widened region is greater by twice the wall thickness of the displaced material of the jacket than the diameter of the bore in the forward region.

3. The hard-core jacketed bullet according to claim 1, characterized in that the wall thickness of the displaced material of the jacket is between 0.1 mm and 1.5 mm.

4. The hard-core jacketed bullet according to claim 1, characterized in that the diameter of the bore in the forward region and the diameter in the region of the opening with displaced material of the jacket therein are of equal size.

5. A method of manufacturing a hard-core jacketed bullet for containing a tracer composition, comprising providing a hard core having a bore at a rear thereof, the bore having a forward region in which a tracer composition is contained and an opening in a rear region, mounting jacket on the core, the jacket encasing at least a rear part of the hard core, wherein, after mounting of the jacket onto the core the jacket in the rear region of the bullet, the base of the jacket is broached in the entre of the opening of the bore for the tracer composition by means of a punch provided with a conical tip and that during engagement of the punch into the bore the displaced jacket material is pressed uniformly against the wall of the bore by means of an operation comparable to forming, simultaneously reducing the wall thickness of the base, and wherein the bore in the region of the opening has a widened region for receiving the material of the base of the jacket that is displaced during the production of the opening so that the diameter of the opening with displaced material of the jacket therein is at least equal to the diameter of the bore at the forward region.

6. The method according to claim 5, characterized in that it is usable for all calibres.

7. The method according to claim 5, characterized in that the diameter of the widened region is greater by twice the wall thickness of the displaced material of the jacket than the diameter of the bore in the forward region.

8. The method according to claim 5, characterized in that the wall thickness of the displaced material of the jacket is between 0.1 mm and 1.5 mm.

9. The method according to claim 5, characterized in that the diameter of the bore in the forward region and the diameter in the region of the opening with displaced material of the jacket therein are of equal size.

10. A hard-core jacketed bullet for containing a tracer composition manufactured by the method according to claim 5.

* * * * *